US008870321B2

(12) United States Patent
Hayashi

(10) Patent No.: US 8,870,321 B2
(45) Date of Patent: Oct. 28, 2014

(54) INKJET RECORDING APPARATUS

(71) Applicant: Ryuichi Hayashi, Ibaraki (JP)

(72) Inventor: Ryuichi Hayashi, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/928,542

(22) Filed: Jun. 27, 2013

(65) Prior Publication Data

US 2014/0015902 A1 Jan. 16, 2014

(30) Foreign Application Priority Data

Jul. 11, 2012 (JP) ..... 2012-155799

(51) Int. Cl.
*B41J 29/38* (2006.01)
*B41J 2/045* (2006.01)

(52) U.S. Cl.
CPC ..... *B41J 2/04581* (2013.01); *B41J 2/0451* (2013.01); *B41J 2/04588* (2013.01)
USPC ..... 347/10; 347/68

(58) Field of Classification Search
None
See application file for complete search history.

(56) References Cited

U.S. PATENT DOCUMENTS 5,563,634 A 10/1996 Fujii et al.
5,644,341 A 7/1997 Fujii et al.
5,818,473 A 10/1998 Fujii et al.
6,893,104 B2 * 5/2005 Tamura ..... 347/12

FOREIGN PATENT DOCUMENTS

JP 3252628 11/2001
JP 2011-037196 2/2011

* cited by examiner

*Primary Examiner* — Geoffrey Mruk
(74) *Attorney, Agent, or Firm* — Harness, Dickey & Pierce, P.L.C.

(57) ABSTRACT

An inkjet recording apparatus comprises an inkjet recording head configured to eject an ink droplet from a nozzle by utilizing micro vibrations of a piezoelectric element; and a recording-head driving circuit configured to apply a drive voltage to the piezoelectric element. And, in the apparatus, the recording-head driving circuit includes a D/A converter configured to generate an analog voltage from and corresponding to digital data input to the D/A converter, and a reference-voltage generating circuit configured to generate a reference voltage of the D/A converter, and the reference-voltage generating circuit is configured to be capable of controlling a manner in which the reference voltage falls when an anomaly occurs to the inkjet recording apparatus.

3 Claims, 5 Drawing Sheets

(a)

(b)

INKJET RECORDING APPARATUS

CROSS-REFERENCE TO RELATED APPLICATIONS

The present application claims priority to and incorporates by reference the entire contents of Japanese Patent Application No. 2012-155799 filed in Japan on Jul. 11, 2012.

BACKGROUND OF THE INVENTION

1. Field of the Invention

The present invention generally relates to an inkjet recording apparatus that forms an image by ejecting an ink droplet onto a recording medium and, more particularly, to a recording-head driving circuit that outputs a driving signal to a piezoelectric element for use in ejecting the ink droplet.

2. Description of the Related Art

An inkjet recording apparatus is known as one of image forming apparatuses including printing machines, facsimile machines, copier machines, and multifunction peripherals having two or more functions of these machines. The inkjet recording apparatus generally forms a desired image by ejecting ink droplets onto a recording medium, such as paper or transparency, from an inkjet recording head.

Such an inkjet recording head typically employs a method that uses a piezoelectric element as a pressure generator for pressurizing ink in an ink channel, and ejects an ink droplet by causing the piezoelectric element to micro-vibrate a diaphragm, which is a wall of the ink channel, thereby changing internal volume of the ink channel.

An overcurrent anomaly caused by a short-circuited load or an anomaly related to power supply voltage, such as an over voltage or a low voltage, can occur in an inkjet recording apparatus. There are conventionally known techniques for such an anomaly. One of the techniques protects circuitry by providing a power-supply control circuit in the inkjet recording apparatus and stopping power supply to the inkjet recording head and to a driving circuit at occurrence of an anomaly. Another technique prevents ejection of an unnecessary ink droplet, which can occur due to residual charges at occurrence of an anomaly, by applying a voltage that is in anti-phase with a driving voltage supplied to the piezoelectric element.

For instance, Japanese Patent Application Laid-open No. 2011-037196 discloses a technique (first conventional technique) for protecting a driving circuit from an anomalous short circuit between various connecting lines that can occur in an unexpected manner. According to this technique, when an anomalous short circuit is detected, a control circuit stops power-supply output from a power-supply generating circuit and the like, thereby stopping supplying power source to load of an inkjet recording head. Simultaneously, the control circuit stops supplying power source to a circuit(s) (more specifically, circuit components connected to a load power-supply line), to which the power source is supplied from the power-supply generating circuit, among the driving circuit.

According to this first conventional technique, supply of power source to a drive-voltage output circuit (specifically, an isolator driver IC or the like) can be stopped, and therefore supply of the drive voltage to the inkjet recording head can be stopped.

Japanese Patent No. 3252628 discloses a second conventional technique. According to this technique, a control circuit applies a refresh pulse voltage that is in anti-phase with an applied pulse voltage (drive voltage) in order to eliminate residual charges between a diaphragm and an electrode, thereby preventing an unnecessary ink droplet from being ejected by an electric field produced by the residual charges. In the second conventional technique, during normal driving, electrodes are formed respectively both sides of the diaphragm that has a function as a capacitor, and the electrodes is applied with voltages to generate mechanical vibrations, thereby the ejection is performed.

According to the second conventional technique, constants of an external resistor and a capacitor, which is made up of the diaphragm and the electrode, are set to desired values, thereby determining a time constant over which the residual charges are to be discharged. By causing a trailing edge of the refresh pulse voltage to be sloped, ejection of an unnecessary ink droplet can be effectively prevented.

However, the control method according to the first conventional technique that stops supplying the power source to the inkjet recording head and to the driving circuit when printing operation is stopped is disadvantageous in that a rise rate of the voltage applied to the piezoelectric element is uncontrollable. This is because the voltage applied to the piezoelectric element is placed in a transient state when the power supply is stopped, and the applied voltage depends on a load capacitance connected to the power source.

An inkjet recording head ejects an ink droplet by applying a voltage onto a piezoelectric element to deform the piezoelectric element; accordingly, the ink droplet ejection depends on a deformation amount and a deformation rate of the piezoelectric element. In particular, when the load capacitance connected to the power source is small, the applied voltage falls rapidly, and therefore the piezoelectric element deforms rapidly, resulting in ejection of an unnecessary ink droplet. Furthermore, the rapid deformation leads to early degradation of the piezoelectric element, which is also disadvantageous. These problems are specifically described later.

The second conventional technique that applies to the piezoelectric element the voltage that is in anti-phase with the drive voltage is effective in preventing ejection of an unnecessary ink droplet caused by residual charges during normal driving. However, this technique is incapable of solve the problem of ejection of an unnecessary ink droplet that occurs at occurrence of an anomaly because a printing pulse falls earlier than the refresh pulse voltage is applied.

There is a need for an inkjet recording apparatus capable of, at occurrence of an anomaly in the inkjet recording apparatus, protecting a reference-voltage generating circuit that generates a reference voltage for use in driving a piezoelectric element, and simultaneously preventing ejection of an unnecessary ink droplet from an inkjet recording head and early degradation of the piezoelectric element.

SUMMARY OF THE INVENTION

It is an object of the present invention to at least partially solve the problems in the conventional technology.

According to the present invention, there is provided: an inkjet recording apparatus comprises an inkjet recording head configured to eject an ink droplet from a nozzle by utilizing micro vibrations of a piezoelectric element; and a recording-head driving circuit configured to apply a drive voltage to the piezoelectric element. And, in the inkjet recording apparatus, the recording-head driving circuit includes a D/A converter configured to generate an analog voltage from and corresponding to digital data input to the D/A converter, and a reference-voltage generating circuit configured to generate a reference voltage of the D/A converter, and the reference-voltage generating circuit is configured to be capable of controlling a manner in which the reference voltage falls when an anomaly occurs to the inkjet recording apparatus.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

As described above, an overcurrent anomaly caused by a short-circuited load or a power supply voltage anomaly, such as an over voltage or a low voltage, can occur in an inkjet recording apparatus. According to an aspect of an embodiment of the present invention, an inkjet recording apparatus is configured as follows to prevent ejection of an unnecessary ink droplet from an inkjet recording head at occurrence of an anomaly in the inkjet recording apparatus and early degradation of a piezoelectric element.

More specifically, the inkjet recording apparatus includes a voltage pull-down circuit (reference-voltage generating circuit), which is made up of a switching device and a CR (capacitor-resistor) circuit, connected to a reference voltage terminal of a D/A converter. When any anomaly, e.g., short-circuit anomaly, occurs in the inkjet recording apparatus, the switching device is switched on to discharge charges built up on the capacitor. As a result, a reference voltage falls more slowly than a reference voltage according to the control method of the first conventional technique does.

Thus, the reference-voltage generating circuit that generates the reference voltage for use in driving the piezoelectric element can be protected. Furthermore, it is possible to control a fall rate of an applied voltage in a transient state by setting a capacitance C and a resistance R of the CR circuit to values according to a load capacitance connected to power source.

Because the fall rate of the applied voltage in the transient state is controllable, it is possible to control a deformation rate of the piezoelectric element.

Figure 1:
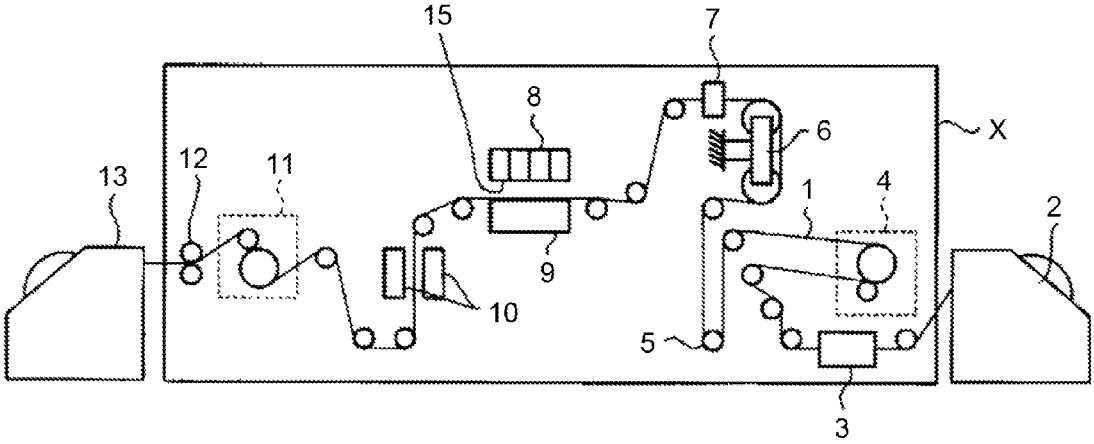
FIG. 1 is a general configuration diagram of an inkjet recording apparatus according to an embodiment of the present invention.

An exemplary embodiment of the present invention is described below with reference to the accompanying drawings. FIG. 1 is a general configuration diagram of an inkjet recording apparatus X according to an embodiment of the present invention.

The inkjet recording apparatus X is arranged between a paper feed unit 2 and a paper receiving unit 13. Continuous recording paper (a recording medium, on which an image is to be recorded) 1 is unwound and fed from the paper feed unit 2 at a high speed to the inkjet recording apparatus X, where a desired color image is formed on the recording paper 1. The recording paper 1 is wound up by and stored in the paper receiving unit 13.

A paper conveying device in the inkjet recording apparatus X includes a restriction guide 3, infeed rollers 4 including a driving roller and a driven roller, a dancer roller 5, an edge position controller (EPC) 6 that controls skew of the recording paper 1, a skew-amount detector 7 for use in feedback of a skew amount, outfeed rollers 11, and puller rollers 12. The restriction guide 3 performs positioning of the recording paper 1 fed from the paper feed unit 2 in a width direction. The dancer roller 5 outputs a position signal that depends on a tension on the recording paper 1. The outfeed rollers 11 include a driving roller and a driven roller that rotate at a fixed speed to convey the recording paper 1 at a preset velocity. The puller rollers 12 include a driving roller and a driven roller that discharge the recording paper 1 out of the apparatus.

The paper conveying device is a tension-control-type paper conveying device that detects a position of the dancer roller 5 and maintains the tension on the recording paper 1, which is being conveyed, by controlling rotations of the infeed rollers 4 based on the detected position.

The inkjet recording apparatus X internally includes an inkjet recording head 8, a platen 9 arranged to face the inkjet recording head 8, and a drier 10 arranged downstream of the inkjet recording head 8 in a conveying direction.

The inkjet recording head 8 includes line heads, on each of which printing nozzles 19 (see FIG. 3) are arranged across an entire printing width. Color printing is performed using black, cyan, magenta, and yellow line heads. As illustrated in FIG. 1, each of the line heads is supported in such a manner that an ink-droplet-ejection nozzle surface 15 (see FIG. 3) of the line head is above the platen 9 with a predetermined clearance therebetween. The inkjet recording head 8 forms a color image on the recording paper 1 by ejecting ink droplets in synchronization with a paper conveying velocity.

The drier 10 is used to fix the color image formed by the inkjet recording head 8 onto the recording paper 1. The drier 10 employed in the present embodiment is a non-contact type drying device and some distance away from the recording paper 1. However, the drier 10 may alternatively be a contact-type drying device.

Figure 2:
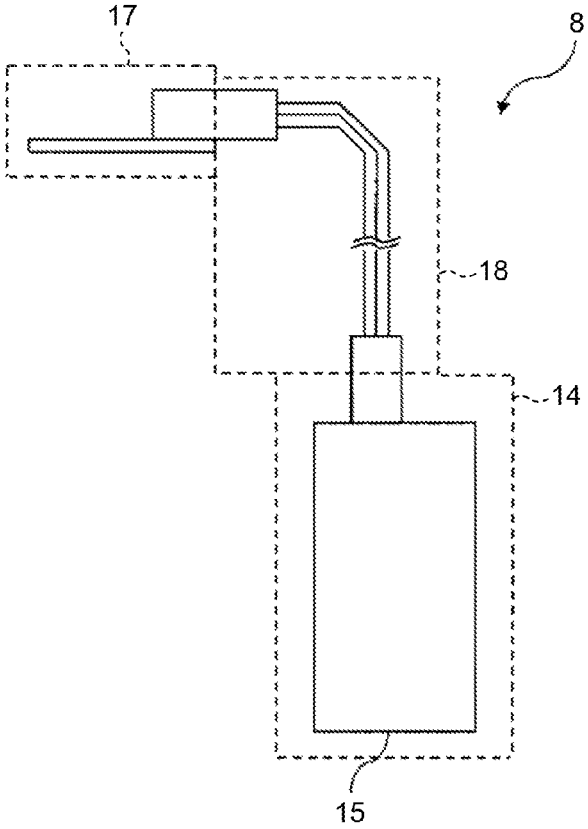
FIG. 2 is a side view illustrating a general configuration of an entire inkjet recording head used in the inkjet recording apparatus illustrated in FIG. 1.

FIG. 2 is a side view illustrating a general configuration of the entire inkjet recording head 8.

As illustrated in FIG. 2, the inkjet recording head 8 includes a recording head body 14, a driver board (upper board) 17, and a twist flat cable 18. The recording head body 14 and the driver board (upper board) 17 are connected to each other via the twist flat cable 18.

Figure 4:
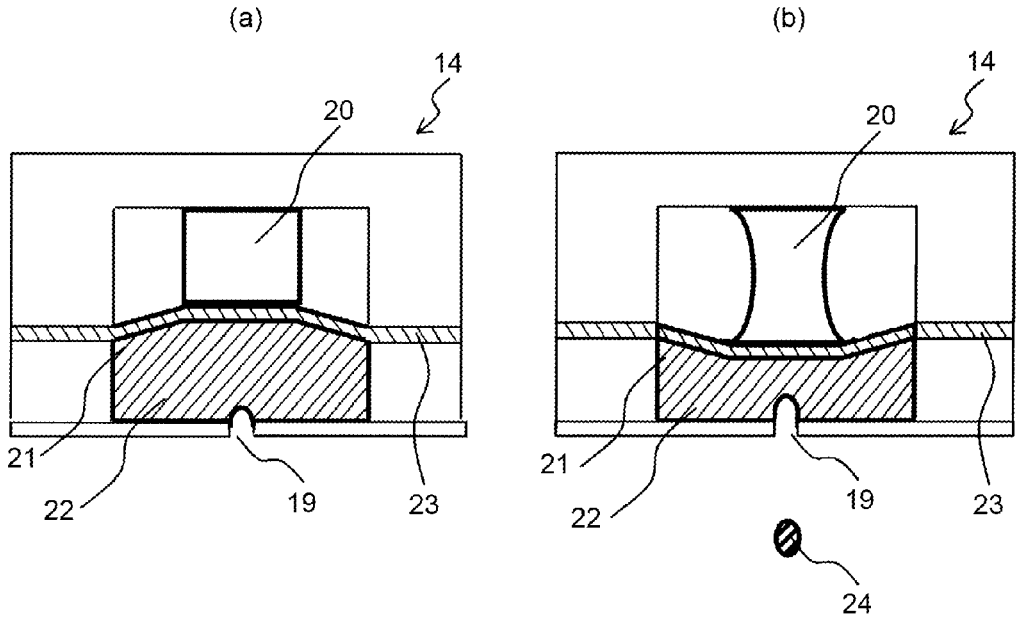
FIGS. 4(*a*) and 4(*b*) are explanatory diagrams of a principle according to which a recording head body ejects an ink droplet, FIG. 4(*a*) being a diagram illustrating a state where a drive voltage is not applied to a piezoelectric element yet, FIG. 4(*b*) being a diagram illustrating a state where the drive voltage is applied to the piezoelectric element.

The driver board 17 is a rigid circuit board, on which circuitry for generating drive waveforms for driving piezoelectric elements 20 (see FIGS. 4(*a*) and 4(*b*)) in the recording head body 14 and image data signals is mounted.

As illustrated in FIG. 2, the bottom surface of the recording head body 14 is configured as the ink-droplet-ejection nozzle surface 15. When failure of the recording head body 14 should occur, only the recording head body 14 is to be replaced by disconnecting the recording head body 14 from the twist flat cable 18.

FIG. 2 illustrates the driver board 17 and the recording head body 14 in a one-to-one relationship for brevity of the drawing. However, in actual configuration, it is possible to connect a plurality of pieces of the recording head body 14 to a single piece of the driver board 17.

Figure 3:
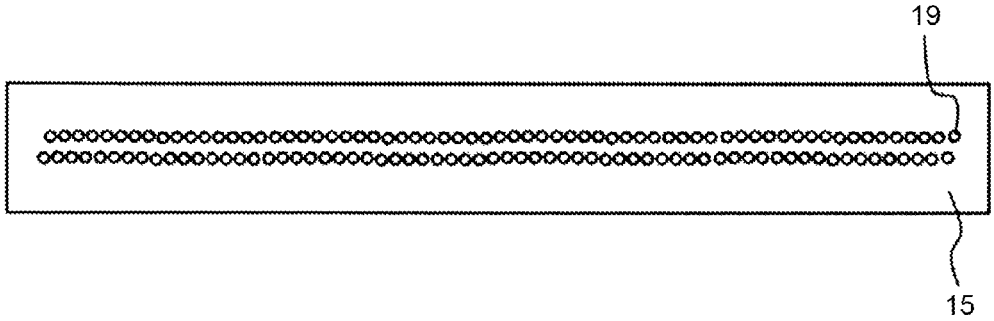
FIG. 3 is an enlarged bottom view of an ink-droplet-ejection nozzle surface of the inkjet recording head illustrated in FIG. 2.

FIG. 3 is an enlarged bottom view of the ink-droplet-ejection nozzle surface 15.

As illustrated in FIG. 3, the large number of printing nozzles 19 are arranged on the ink-droplet-ejection nozzle surface 15 in a staggered arrangement. In the present embodiment, the printing nozzles 19 are arranged in two staggered rows, each row containing 64 pieces of the printing nozzles 19. By arranging the large number of printing nozzles 19 in such a staggered arrangement, high-resolution printing is enabled.

FIGS. 4(*a*) and 4(*b*) are explanatory diagrams of a principle, according to which the recording head body 14 ejects an ink droplet. FIG. 4(*a*) is a diagram illustrating a state where a drive voltage is not applied to the piezoelectric element 20 yet. FIG. 4(*b*) is a diagram illustrating a state where the drive voltage is applied to the piezoelectric element 20.

As illustrated in FIGS. 4(*a*) and 4(*b*), the piezoelectric element 20 is used as a pressure generator that pressurizes ink 22, with which a pressure chamber 21 is filled. An ink droplet 24 is ejected according to the following principle: when the piezoelectric element 20 is vertically deformed as illustrated in FIG. 4(*b*) according to an amplitude and a slew rate of a voltage applied to the piezoelectric element 20, the piezoelectric element 20 pressurizes the ink 22 in the pressure chamber 21 (to change internal volume of the pressure chamber 21 from that illustrated in FIG. 4(*a*) to that illustrated in FIG. 4(*b*)) via a diaphragm 23, which is a wall of the pressure chamber 21. As a result, the ink droplet 24 is ejected from the printing nozzle 19.

The recording head body 14 is configured so as to prevent degradation of the piezoelectric element 20 by not bringing the piezoelectric element 20 into direct contact with the ink 22 in the pressure chamber 21.

Figure 5:
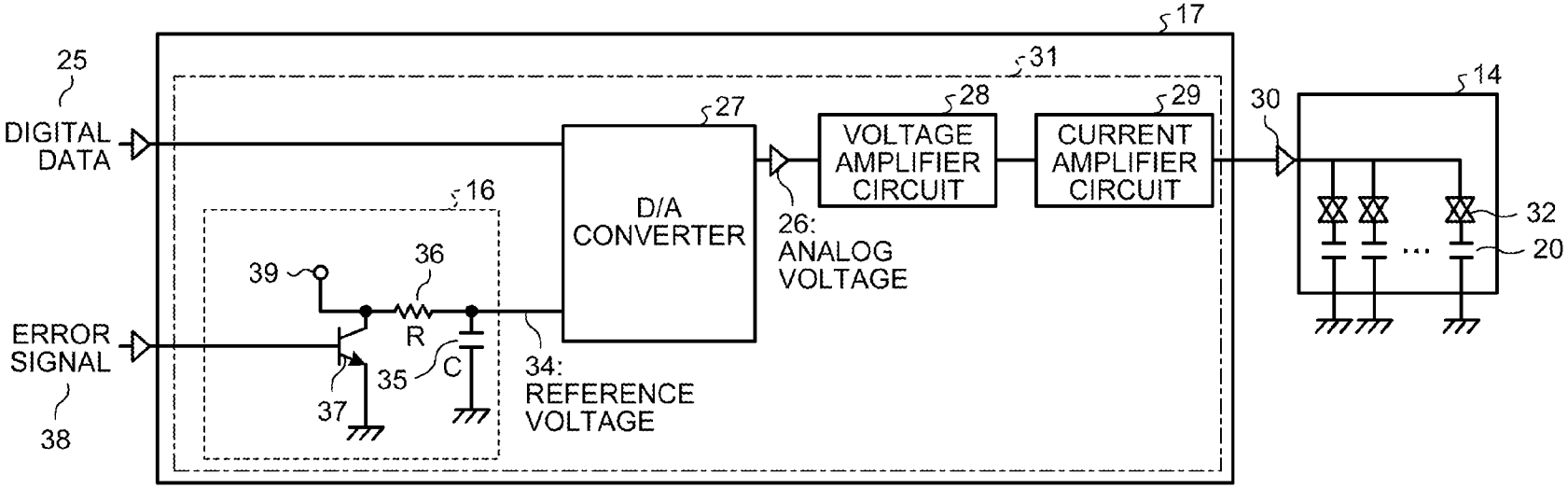
FIG. 5 is a block diagram illustrating a recording-head driving circuit mounted on a driver board (upper board) according to the embodiment.

FIG. 5 is a block diagram illustrating a recording-head driving circuit 31 of the driver board (upper board) 17.

As illustrated in FIG. 5, the recording-head driving circuit 31 mounted on the driver board 17 includes a D/A converter 27 that generates an analog voltage 26 from and corresponding to digital data 25 input to the D/A converter 27, a voltage amplifier circuit 28 that amplifies the analog voltage 26, a current amplifier circuit 29 that amplifies a current level of a voltage output from the voltage amplifier circuit 28, and a voltage pull-down circuit (reference-voltage generating circuit) 16. Each of the voltage amplifier circuit 28 and the current amplifier circuit 29 has a known configuration, and detailed description thereabout is omitted.

Ejection of the ink droplet 24 (see FIG. 4(*b*)) is controlled by applying a drive voltage 30 output from the current amplifier circuit 29 (of the recording-head driving circuit 31) to the inkjet recording head body 14. The inkjet recording head body 14 includes a large number of drive units, each of which is made up of the piezoelectric element 20 and a transfer gate 32 that form a pair. The transfer gate 32 performs on/off control according to whether or not there is the ink droplet 24.

The voltage pull-down circuit (reference-voltage generating circuit) 16 includes a CR circuit, a switching device 37, and a voltage source 39 that are connected as illustrated in FIG. 5. The CR circuit is made up of a capacitor 35 and a resistor 36. The voltage pull-down circuit (reference-voltage generating circuit) 16 is connected to an input terminal of a reference voltage 34 of the D/A converter 27.

A bipolar junction transistor (BJT), a field effect transistor (FET), or the like is used as the switching device 37. When a BJT or an FET is employed, the switching device 37 can perform switching at a high speed by amplifying a digital signal having a small electric current or a low voltage that is output as an error signal 38 from a control IC of the inkjet recording apparatus X.

Operations of the voltage pull-down circuit 16 according to the present embodiment at occurrence of an anomaly are described below.

When an anomaly occurs and the error signal 38 is input to the switching device 37 of the voltage pull-down circuit 16, the switching device 37 is placed in ON state, where the reference voltage 34 of the D/A converter 27 is pulled down to the ground level. The analog voltage 26 output from the D/A converter 27 is generated with reference to the voltage source 39 that is input to the terminal of the reference voltage 34 of the D/A converter 27. Accordingly, the drive voltage 30 output from the recording-head driving circuit 31 also falls in synchronization with the fall of the reference voltage 34 at the D/A converter 27.

When fall time of the reference voltage 34 of the D/A converter 27 at occurrence of an anomaly is denoted by $\tau$, the fall time $\tau$ is expressed as a product of a capacitance C of the capacitor 35 and a resistance R of the resistor 36 (i.e., $\tau = C \times R$). It is possible to control the fall time $\tau$ of the reference voltage 34 of the D/A converter 27 and fall time of the drive voltage 30 of the recording-head driving circuit 31 as desired by setting the capacitance C and the resistance R to values according to characteristics of the inkjet recording head body 14.

According to the first conventional technique, the control circuit stops supplying the power source to the driving circuit at occurrence of an anomaly, thereby instantaneously stopping the drive voltage supplied to the inkjet recording head. However, this technique is incapable of preventing ejection of an unnecessary ink droplet caused by a sharp fall in the drive voltage and early degradation of the piezoelectric element.

The control method of the second conventional technique includes setting values of the capacitor, which is made up of the diaphragm and the electrode, and the external resistor, and applying the refresh pulse voltage that is in anti-phase with the printing pulse voltage, which is the drive voltage during normal driving. This technique is effective in preventing ejection of an useless ink droplet caused by residual charges during normal driving. However, because the refresh pulse voltage has a certain pulse width, when printing operation is stopped by occurrence of an anomaly, the printing pulse voltage sharply rises earlier than the refresh pulse voltage is applied. In such a case, ejection of an useless ink droplet cannot be prevented.

In contrast, according to the present embodiment, the voltage pull-down circuit 16 made up of the CR circuit and the switching device 37 is connected to the terminal of the reference voltage 34 of the D/A converter 27. Accordingly, fall time of the drive voltage 30 applied to the inkjet recording head body 14 can be controlled to a desired value by, in response to the error signal 38 that is input at an instant when an anomaly occurs, discharging the reference voltage 34 of the D/A converter 27 over the desired fall time.

As a result, ejection of an unnecessary ink droplet at occurrence of an anomaly and early degradation of the piezoelectric element can be prevented.

Figure 6:
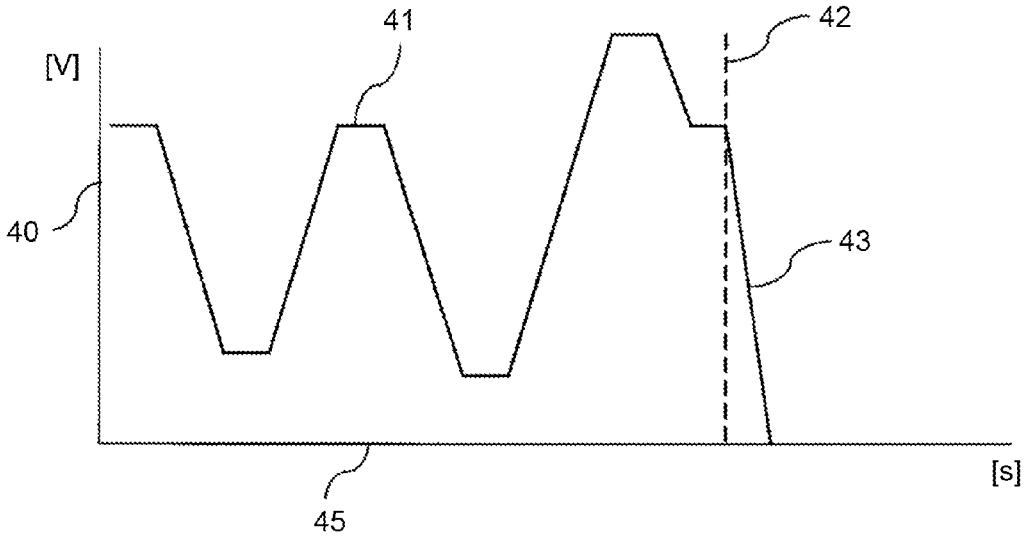
FIGS. 6(*a*) and 6(*b*) are waveform charts of drive voltages supplied to an inkjet recording head, FIG. 6(*a*) being a waveform chart of a drive voltage according to a control method of a first conventional technique, FIG. 6(*b*) being a waveform chart of a drive voltage according to the embodiment.
Figure 6:
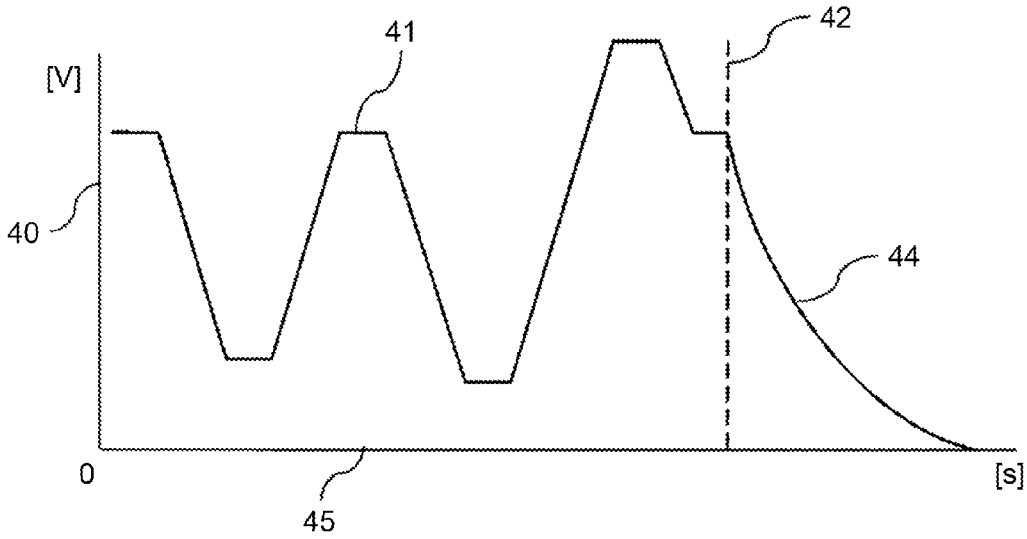

FIGS. 6(*a*) and 6(*b*) are waveform charts of drive voltages supplied to an inkjet recording head plotted against two axes, which are a voltage axis 40 and a time axis 45.

FIG. 6(*a*) is a waveform chart of a drive voltage according to the control method of the first conventional technique. Power supply to the output circuit is stopped immediately after an error-signal-input instant 42. Accordingly, a drive voltage 41, which is a drive voltage during normal driving, can become a drive voltage 43 that sharply falls in a transient state depending on a load capacitance connected to the power source.

FIG. 6(*b*) is a waveform chart of a drive voltage according to the embodiment. The CR circuit made up of the capacitor 35 and the resistor 36 is connected to the reference voltage 34 of the D/A converter 27 illustrated in FIG. 5. The capacitance C of the capacitor 35 and the resistance R of the resistor 36 can be set to desired values according to a load capacitance connected to the power source.

Accordingly, it is possible to control a drive voltage 44 in a transient state immediately after the error-signal-input instant 42 so that the drive voltage 44 falls slowly as illustrated in FIG. 6(*b*).

Figure 7:
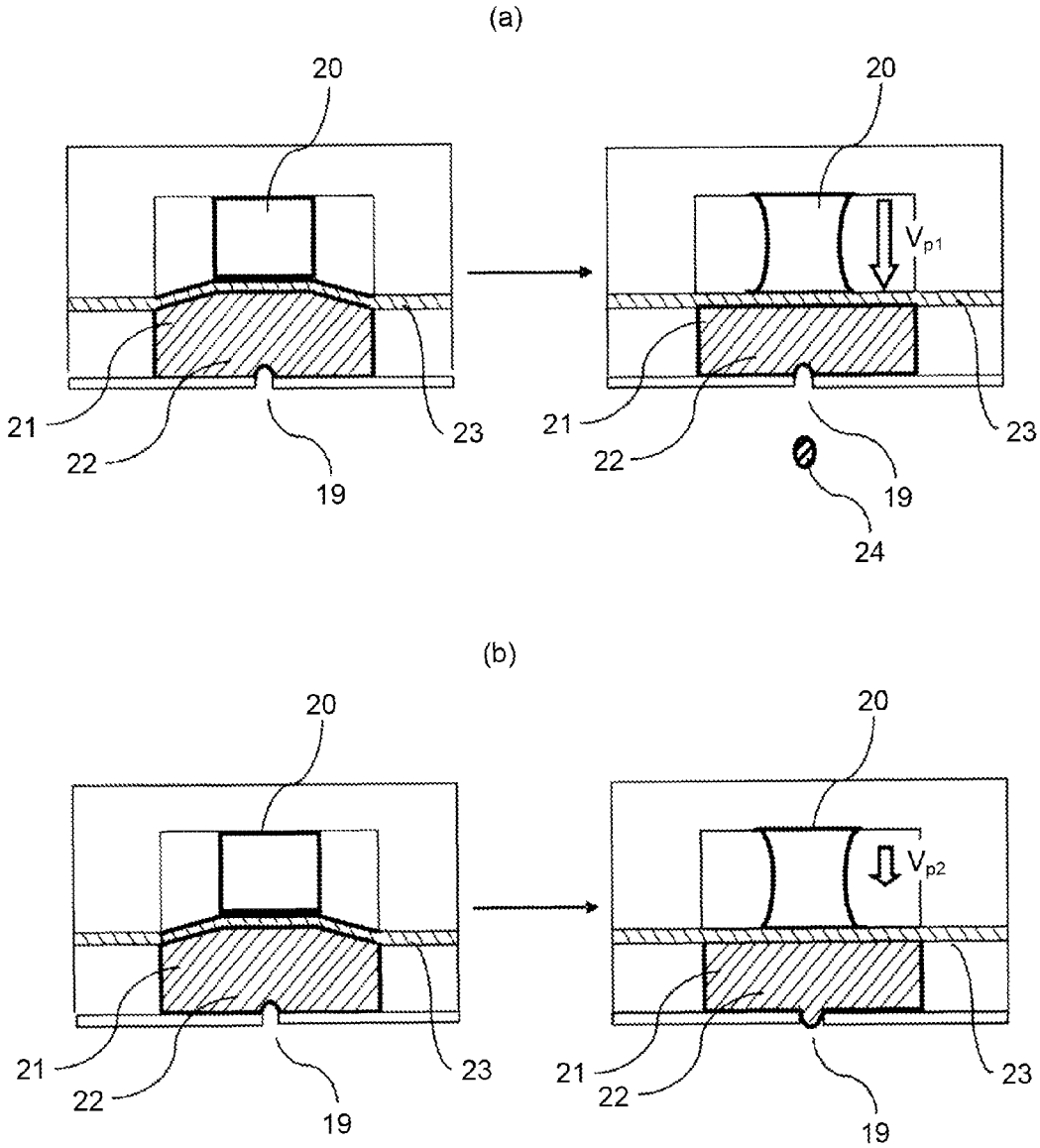
FIGS. 7(*a*) and 7(*b*) are diagrams each describing how a piezoelectric element operates at occurrence of an anomaly, FIG. 7(*a*) being a diagram describing an operation of the piezoelectric element according to the control method of the first conventional technique, FIG. 7(*b*) being a diagram describing an operation of the piezoelectric element according to the embodiment.

FIGS. 7(*a*) and 7(*b*) are diagrams illustrating operations of the piezoelectric element 20 at occurrence of an anomaly by way of comparison between a conventional technique and the present embodiment.

FIG. 7(*a*) is a diagram describing an operation of the piezoelectric element 20 according to the first conventional technique. It is assumed that the piezoelectric element 20 deforms at a deformation rate $V_{P1}$ in the transient state immediately after the error-signal-input instant 42 illustrated in FIG. 6(*a*). The drive voltage 41 can become the drive voltage 43 (see FIG. 6(*a*)) that sharply falls depending on a load capacitance connected to the power source. In such a case, pressure applied to the pressure chamber 21 changes greatly, causing the piezoelectric element 20 to deform at the deformation rate $V_{P1}$, at which the ink droplet 24 is uselessly ejected from the printing nozzle 19, even after application of the drive voltage 43 is stopped.

Furthermore, rapid deformation of the piezoelectric element 20 caused by the sudden change in voltage can result in early degradation of the piezoelectric element 20.

FIG. 7(*b*) is a diagram describing an operation of the piezoelectric element 20 according to the present embodiment. It is assumed that the piezoelectric element 20 deforms at a deformation rate $V_{P2}$ in a transient state immediately after the error-signal-input instant 42 illustrated in FIG. 6(*b*). According to the present embodiment, it is possible to perform control so that the drive voltage 41 becomes the drive voltage 44 (see FIG. 6(*b*)) that falls slowly by setting values of the capacitance C and the resistance R of the CR circuit connected to the input terminal of the reference voltage 34 of the D/A converter 27.

Accordingly, it is possible to reduce a sudden change in pressure applied to the pressure chamber 21 and control the deformation rate to the deformation rate $V_{P2}$ ($<V_{P1}$), at which the ink droplet 24 is not ejected even after application of the drive voltage 43 is stopped. Thus, not only useless ejection the ink droplet 24 is prevented, but also early degradation of the piezoelectric element 20 is prevented because a sudden deformation of the piezoelectric element 20 does not occur.

According to an aspect of the present embodiment, there is provided an inkjet recording apparatus configured as described above to be capable of preventing useless ejection of an ink droplet from an inkjet recording head and early degradation of a piezoelectric element.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An inkjet recording apparatus comprising:

an inkjet recording head configured to eject an ink droplet from a nozzle by utilizing micro vibrations of a piezoelectric element; and a recording-head driving circuit configured to apply a drive voltage to the piezoelectric element, and include a D/A converter configured to generate an analog voltage for generating the drive voltage from and corresponding to digital data input to the D/A converter and a reference-voltage generating circuit configured to generate a reference voltage that the D/A converter generates the analog voltage with reference to, wherein the reference-voltage generating circuit includes a switching device configured to receive an error signal, and a capacitor-resistor circuit connected between the switching device and the D/A converter, and when the error signal is input to the switching device, the switching device is placed ON state where the reference voltage is pulled down.

2. The inkjet recording apparatus according to claim 1, wherein the capacitor-resistor circuit includes a capacitor, and a resistor, and the reference-voltage generating circuit is configured to control fall time $\tau$ of the reference voltage of the D/A converter and fall time of the drive voltage of the recording-head driving circuit by setting a value of a capacitance C of the capacitor and a value of a resistance R of the resistor.

3. The inkjet recording apparatus according to claim 1, wherein the switching device is any one of a bipolar junction transistor and a field effect transistor.

* * * * *